US008246415B2

(12) United States Patent
Lee

(10) Patent No.: US 8,246,415 B2
(45) Date of Patent: Aug. 21, 2012

(54) GEAR BOX FOR USE IN TOY VEHICLES

(75) Inventor: Keung Lee, Hong Kong (CN)

(73) Assignee: New Bright Industrial Co., Ltd., Hong Kong (CN)

( * ) Notice: Subject to any disclaimer, the term of this patent is extended or adjusted under 35 U.S.C. 154(b) by 236 days.

(21) Appl. No.: 12/621,197

(22) Filed: Nov. 18, 2009

(65) Prior Publication Data

US 2011/0117815 A1 May 19, 2011

(51) Int. Cl.
*A62H 17/26* (2006.01)

(52) U.S. Cl. ..... 446/448; 74/414

(58) Field of Classification Search ..... 446/448; 74/414

See application file for complete search history.

(56) References Cited

U.S. PATENT DOCUMENTS

| | | | |
|---|---|---|---|
| 2,767,438 | A | 10/1956 | Pingel |
| 3,150,222 | A | 9/1964 | Blaustein et al. |
| 3,595,372 | A | 7/1971 | Mojden |
| 3,694,127 | A | 9/1972 | Takahashi et al. |
| 3,730,664 | A | 5/1973 | Hultgren |
| 3,891,367 | A | 6/1975 | Signora |
| 3,909,167 | A | 9/1975 | Signora |
| 4,139,176 | A | 2/1979 | Wundsch |
| 4,441,378 | A | 4/1984 | Ponczek |
| 4,890,504 | A | 1/1990 | Carrigan et al. |
| 5,012,691 | A | 5/1991 | Bertot |
| 5,176,103 | A | 1/1993 | Reid et al. |
| 5,444,339 | A | 8/1995 | Domel et al. |
| 5,536,218 | A | 7/1996 | Fukaya et al. |
| 5,584,207 | A | 12/1996 | Paul et al. |
| 5,632,684 | A | 5/1997 | Kumar et al. |
| 5,820,803 | A | 10/1998 | Hashimoto |
| 5,867,864 | A | 2/1999 | Miller et al. |
| 5,906,837 | A | 5/1999 | Link et al. |
| 5,908,067 | A | 6/1999 | Carr |
| 6,165,400 | A | 12/2000 | Hinzmann |
| 6,338,289 | B1 | 1/2002 | Lee |
| 6,663,810 | B1 | 12/2003 | Lee |
| 6,682,336 | B1 | 1/2004 | Lee |
| 7,042,714 | B2 | 5/2006 | Hillman et al. |
| 7,145,768 | B2 | 12/2006 | Hillman et al. |
| 7,209,344 | B2 | 4/2007 | Hillman et al. |
| 7,289,315 | B2 | 10/2007 | Hillman et al. |

*Primary Examiner* — Michael Dennis
(74) *Attorney, Agent, or Firm* — Wilmer Cutler Pickering Hale and Dorr LLP

(57) ABSTRACT

An improved and simplified gear box for toys and other small motorized devices is disclosed. The output gear is a composite piece that integrates a drive shaft with the output gear.

17 Claims, 7 Drawing Sheets

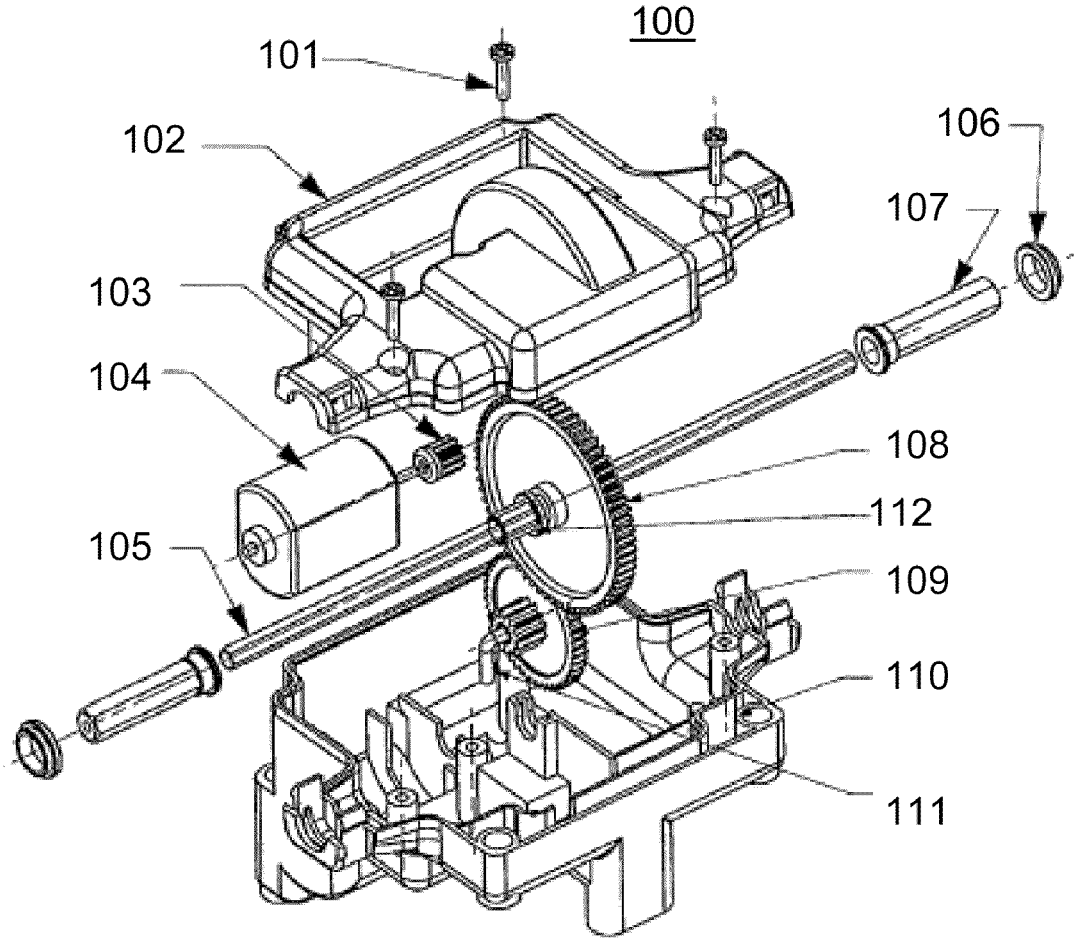
Figure 1-A

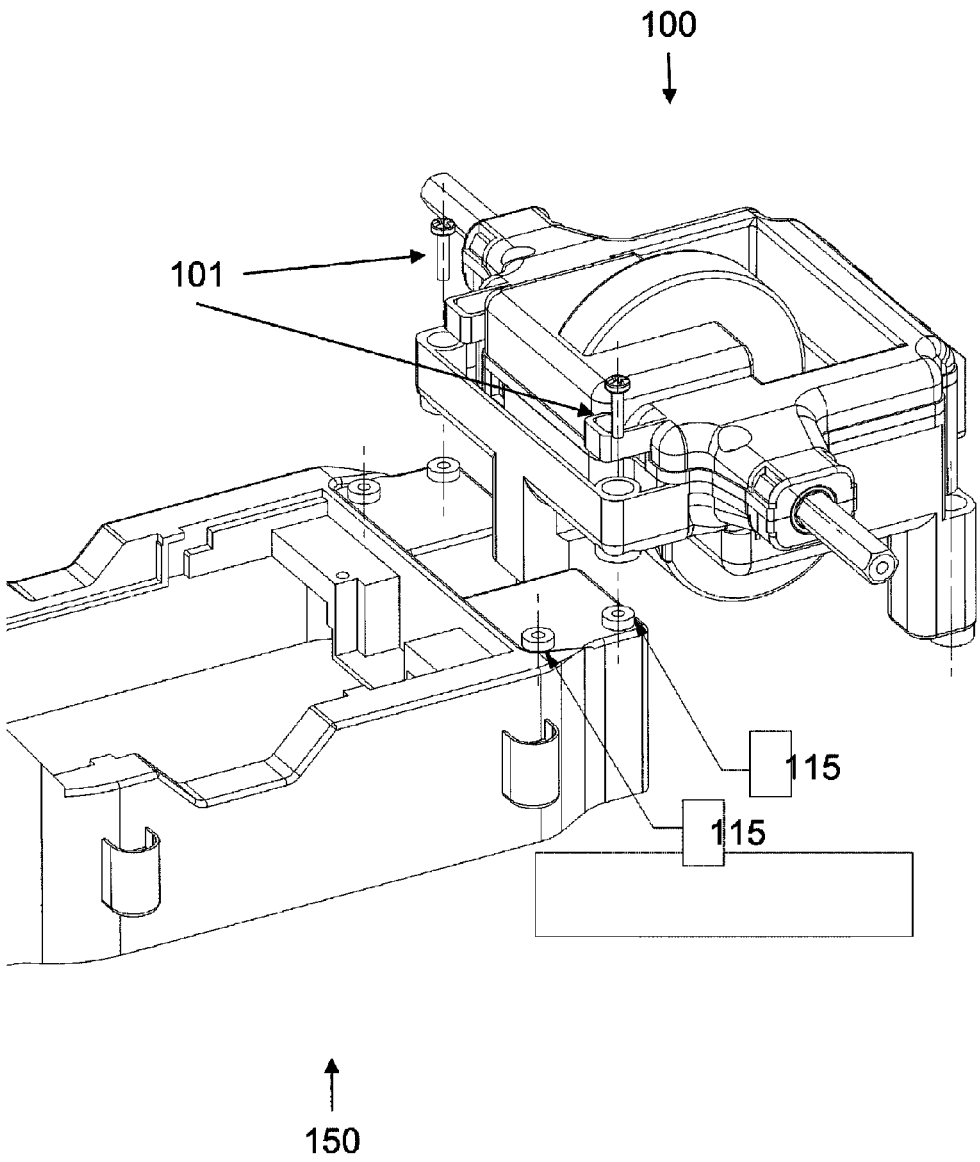
Figure 1-B

GEAR BOX FOR USE IN TOY VEHICLES

TECHNICAL FIELD

The description here relates generally to plastic gear boxes for toys and other small motorized devices, and particularly to simplified gear boxes.

BACKGROUND

There is a continuing and long-felt need for inexpensive, plastic gears for use in toys and similar products or applications. Gears transmit rotational movement and torque forces. Gears may be used to convert the high-speed, low torque output of a rotating electric motor to a low-speed, high torque output of a wheel drive shaft for a toy car. They also may be used to move the mechanical arms of, for example, a toy construction crane. Gears for toys should be safe, inexpensive, easy to assemble, and wear resistant. Plastic gears are suitable for toys because they are safe as they do not have sharp edges (as do metal gears), may be inexpensively formed by injection molding processes, and are tolerant of the dirt and wear encounter by toys, especially toy cars, trucks and construction vehicles.

As illustrated in FIG. 1A, a conventional gear box system 100 for toy vehicles consists of an assembly of the following separate individual components: pinion gear 103, motor 104, hexagonal metal shaft 105, end-supporting bushes 106, hexagonal connecting elements 107, output gear 108, middle-supporting (plastic) bush 112, compound gear 109 and L-shaft 111. These components are assembled and housed between lower cover 102 and upper cover 110, and are fastened by screws 101.

As illustrated in FIG. 1B, conventional gear box system 100 is conventionally attached to conventional chassis 150 by engaging screws 101 with screw cavities 115.

One problem with this conventional system is the difficulty in assembling the components together when each component is molded or manufactured from different machines, as they often are. For example, one has to hold the very small end-supporting bushes 106, the hexagonal connecting elements 107 and the large output gear 108 in position before the metal hexagonal shaft 105 can pass through their cavity with precision and link the various components together. The longer the hexagonal shaft 105, the greater the difficulty is in inserting the shaft 105 through all of the components. Similarly, it is also difficult to insert the L-shaft 111 through the compound gear 109 on one end and to insert the axle of the L-shaft 111 at the other end onto the receiving element in the upper cover 110 of the gear box 100.

Another problem with conventional toy gear boxes is cost. Different components are conventionally made from different materials, and one may have to employ a dual material injection molding machine in the manufacture process. For example, the end-supporting bushes 106 are conventionally made of polyoxymethylene ("POM"), while the gear box compartment is conventionally made of acrylonitrile butadiene styrene ("ABS"). The hexagonal shaft 105 is conventionally made of metal, whereas the output gear 108 and the compound gear 109 are conventionally made of polyamide.

There is thus a need for a more cost effective gear box for use in toys and similar products or applications that is made from fewer materials, made with fewer parts, and is easier to assemble, yet which maintains the durability of conventional toy gear boxes.

SUMMARY

The present embodiment provides a gear box for use in toy vehicles and similar products or applications. The gear box includes an upper cover having a grease groove and an integrated bush with a ridge, a motor engaged with the upper cover, a pinion gear engaged with the motor, a compound gear engaged with the pinion gear, an output gear with an integrated shaft engaged with the compound gear, the integrated shaft of the output gear having a center portion with a substantially circular cross section and end portions with substantially hexagonal cross sections, and a lower cover engaged with the upper cover, wherein the integrated shaft of the output gear extends through the integrated bush of the upper cover.

The output gear in the present embodiment can be made of plastic. The lower cover of the present embodiment can include plastic male locking portions and the upper cover can include plastic female locking portions that engage with the plastic male locking portions. In such gear boxes, the upper and lower covers can be engaged without the use of screws.

BRIEF DESCRIPTION OF DRAWINGS

FIG. 1A illustrates an exploded view of a conventional gear box and all major components.

FIG. 1B illustrates a perspective view of a conventional gear box and a conventional toy chassis.

DETAILED DESCRIPTION

Figure 2:
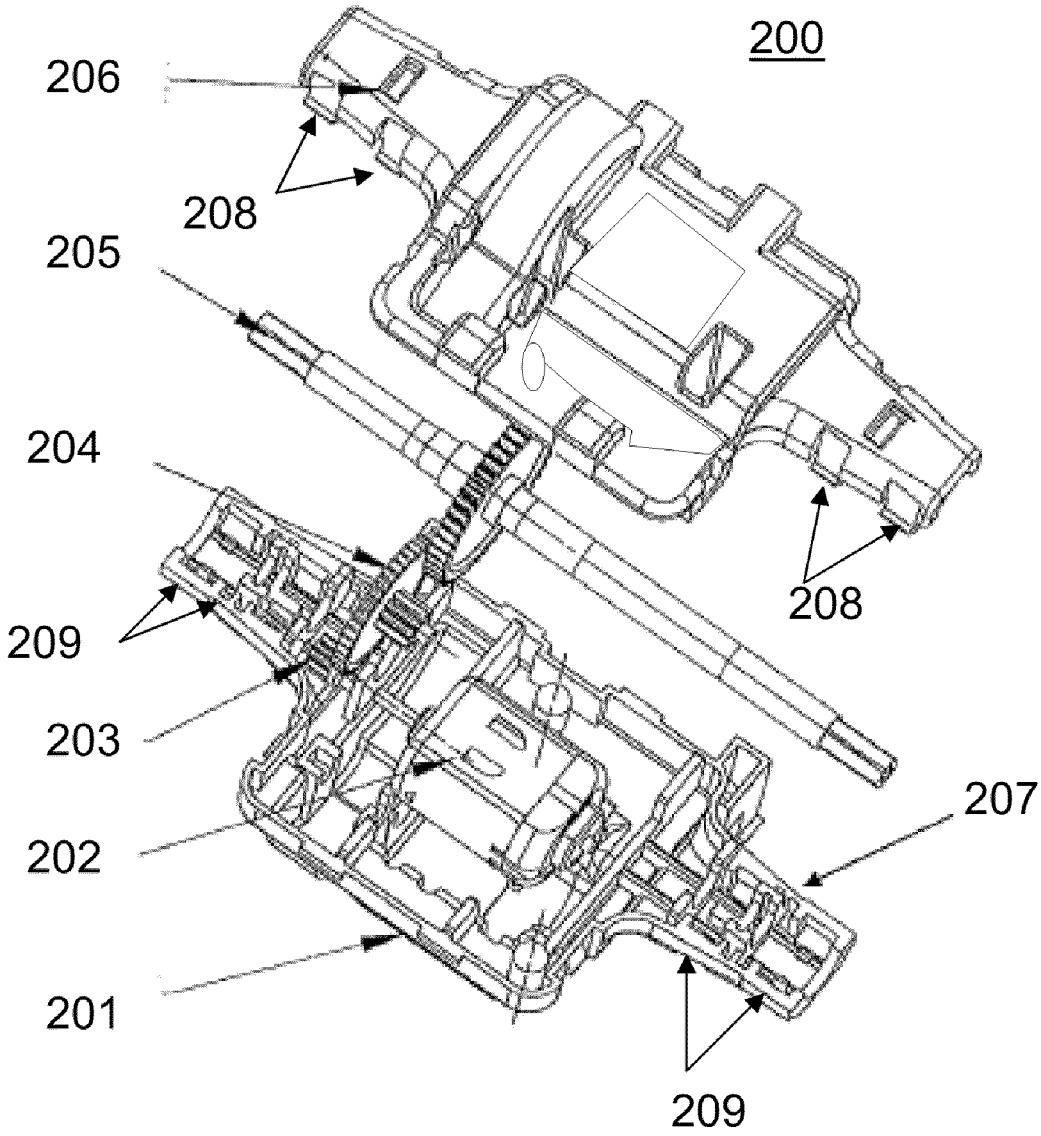
FIG. 2 illustrates an exploded view of a simplified gear box of the present embodiment and all major components

FIG. 2 illustrates an exploded view of a simplified gear box 200, including upper cover 201, motor 202, pinion gear 203, compound gear 204, output gear 205, lower cover 206, and grease groove and integrated bush with ridge 207 that are integral with upper cover 201. Upper cover 201 includes female locking portions 209, while lower cover 206 includes male locking portions 208. Output gear 205 is a composite piece. Output gear 205 integrates hexagonal shaft 105 and output gear 108 of the conventional gear box 100 illustrated in FIG. 1A. The integrated shaft of output gear 205 can have a center portion with a substantially circular cross section and end portions on both sides with substantially hexagonal cross sections. Because of the shaping of output gear 205, end-supporting bushes 106 and hexagonal connecting elements 107 of the conventional gear box 100 illustrated in FIG. 1A are eliminated from the simplified gear box 200. Compound gear 204 also has an integrated shaft which replaces the L-shaft 111 of the conventional gear box 100. The integrated shaft of the output gear can have a shaft length which varies between approximately three inches and approximately eight inches depending on the size of the gear box, where a larger gear box will demand an output gear integrated shaft of longer length. When simplified gear box 200 is used to carry a heavy load, or for high speed applications, one or both of output gear 205 with integrated shaft and compound gear 204 with integrated shaft are preferably made of steel in order to increase the working life span of the gears and integrated shafts.

Grease groove and integrated bush with ridge 207 is provided in upper cover 201. Grease groove 207 allows for the application of a lubricant, such as silicone grease, in order to reduce the friction between the integrated shaft of composite output gear 205 and the portion of the integrated bush with ridge 207 with which it comes in contact. The ridge on the integrated bush 207 on upper cover 201 increases the contact area between upper cover 201 and output gear 205. This increased contact area decreases contact pressure on output gear 205 and therefore increases the lifespan of output gear 205. In addition, the application of a silicone grease on grease groove 207, which comes into contact with the integrated shaft of composite output gear 205, also reduces the frictional torque on composite output gear 205. Although the grease groove 207 is shown in the upper cover 201 of the present embodiment, it may equally be adapted in the lower cover 206 to extend the lubrication effect.

Figure 3:
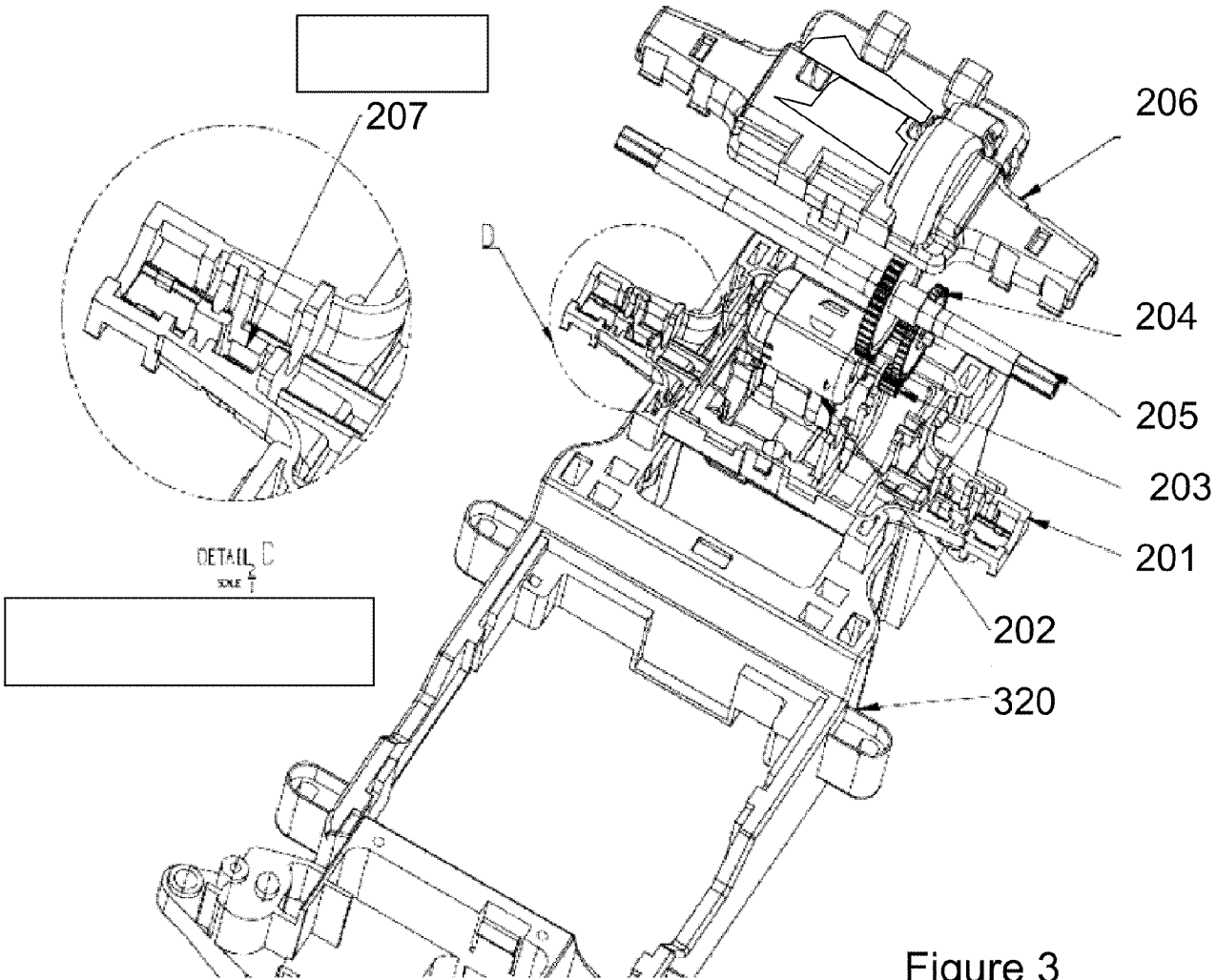
FIG. 3 illustrates an enlarged view of a portion of the upper cover of the simplified gear box.

FIG. 3 illustrates an enlarged view of a portion of the upper cover of the simplified gear box showing how the integrated shaft of the output gear comes into contact with the integrated bush with ridge and grease groove. FIG. 3 includes upper cover 201, compound gear 204, output gear 205, pinion gear 203, lower cover 206, motor 202, chassis 320, and integrated bush with T-ridge 207. The detail portion of integrated bush with T-ridge 207 is shown at a 2:1 scale.

Figure 4:
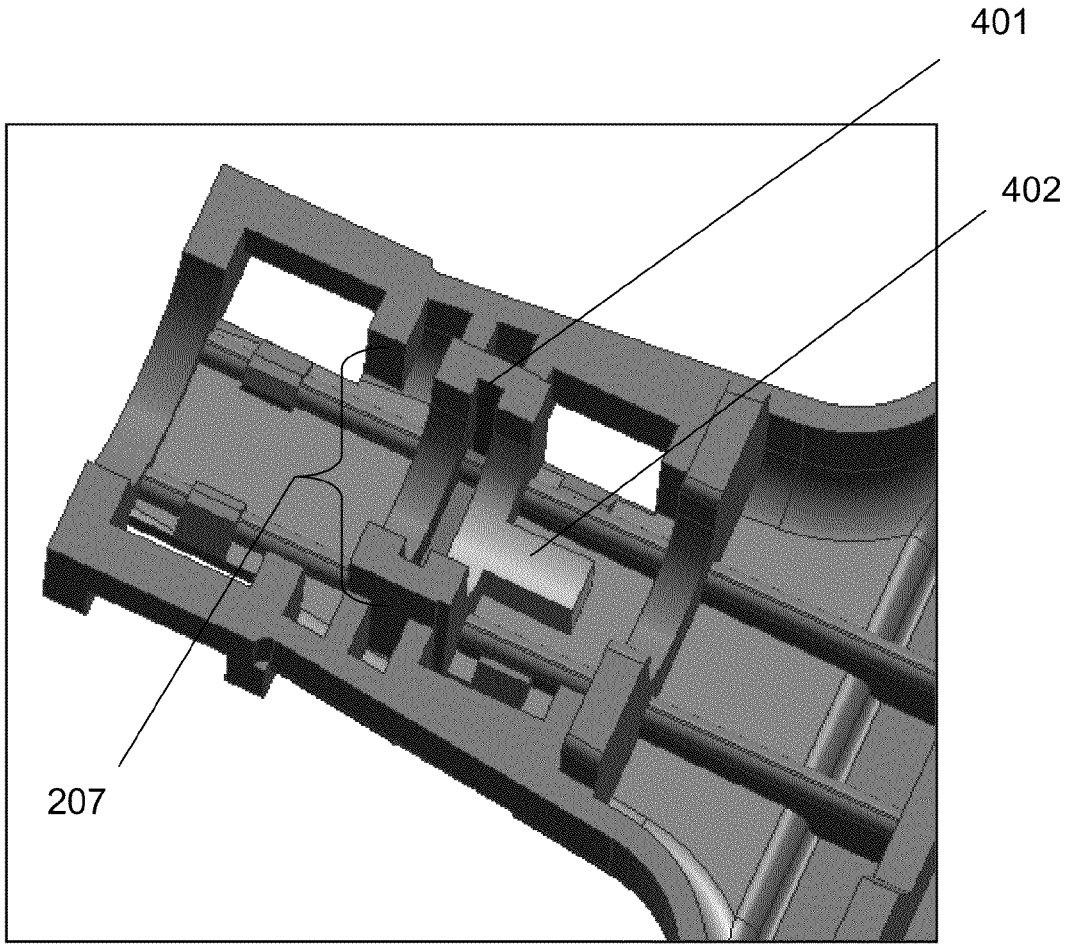
FIG. 4 illustrates an enlarged view of the grease groove, integrated bush, and T-ridge of the upper cover.

FIG. 4 illustrates an enlarged view of the grease groove, integrated bush, and T-ridge 207 of the upper cover. Grease groove and integrated bush with ridge 207 includes integrated bush where grease groove is located 401 and integrated bush where the T-shape ridge is located 402.

The new gear box 200 reduces the number of parts required to be assembled by more than 45% from the conventional gear box 100 illustrated in FIG. 1A. The integrated shaft of output gear 205 is made from plastic rather than the metal that was used to make hexagonal shaft 105 of the conventional gear box 100 in FIG. 1A. This allows the shaft to be integrated into output gear 205, and the entire piece can be made from the same plastic.

Lower cover 206 includes plastic male locking portions 208 that are part of, and extend from the body of, lower cover 206. Similarly, upper cover 201 includes plastic female locking portions 209. As upper cover 201 and lower cover 206 are brought together to close the gear box assembly 200, male locking portions 208 are deflected by female locking portions 209, and then engage with female locking portions 209 such that upper cover 201 and lower cover 206 are fastened together by the engagement of male locking portions 208 and female locking portions 209. The gear box 200 is therefore able to be assembled more easily and securely than the conventional gear box 100 of FIG. 1A. For this reason, screws 101 of the conventional gear box 100 are no longer necessary to hold together the gear box assembly 200.

Because of the integrated pieces of the gear box 200, L-shaft 111 of the conventional gear box 100 is no longer required. In addition, because the integral shaft of output gear 205 is integrated with the output gear, end-supporting bushes 106 and middle-supporting bush 112 of the conventional gear box 100 illustrated in FIG. 1A are no longer necessary, and therefore are not present in the gear box 200. Because the gear box 200 does not require L-shaft 111 of the conventional gear box 100 (see FIG. 1A), compound gear with integrated shaft 204 of the simplified gear box 200 can also be smaller than compound gear 109 of the conventional gear box 100.

Because of the reduction in the number of components and the size of the remaining components necessary for the proper functioning of the gear box 200, both upper cover 201 and lower cover 206 of the simplified gear box 200 can be made smaller than lower cover 102 and upper cover 110 of the conventional gear box 100 illustrated in FIG. 1A These changes allow for lower cost, material usage, and weight.

The reduction in the number and size of parts necessary for the proper functioning of the gear box 200 leads to significant advantages over the conventional gear box 100 illustrated in FIG. 1A. First, the assembly process is drastically reduced. For example, rather than holding and fitting together metal hexagonal shaft 105, middle-supporting bush 112, output gear 108, hexagonal connecting elements 107, and end-supporting bushes 106 of the conventional gear box 100, integrated output gear 205 is preferably prefabricated from a single molding machine as a single piece of plastic. Improvements such as this significantly simplify the time, effort, cost, and errors of assembling the parts of the conventional gear box 100.

Second, a reduction in the size of the overall gear box 200 reduces the materials used to make the gear box 200 as well as the overall weight of the vehicle into which the gear box 200 is placed. Third, because the gear box 200 requires significantly fewer parts than a conventional gear box 100, the gear box 200 requires fewer molds for the manufacturing process. Fourth, more component parts of the gear box 200 are integrated using more homogenous materials and less expensive materials than the conventional gear box 100. For example, the metal hexagonal shaft 105 of the conventional gear box 100 is significantly improved upon by making the shaft the same material as, and integrated with, output gear 205.

Fifth, the grease groove 207, with the integrated bush and ridge, allows for simplification of the assembly process along with a reduction in the number of components. At the same time, the lifespan of the output gear 205 is extended over that of output gear 108 of the conventional gear box 100. These advantages enhance production efficiency and lead to significantly lower assembly and molding costs, while also making the gear box 200 smaller, lighter, and longer lasting than a conventional gear box 100 as illustrated in FIG. 1A.

Figure 5:
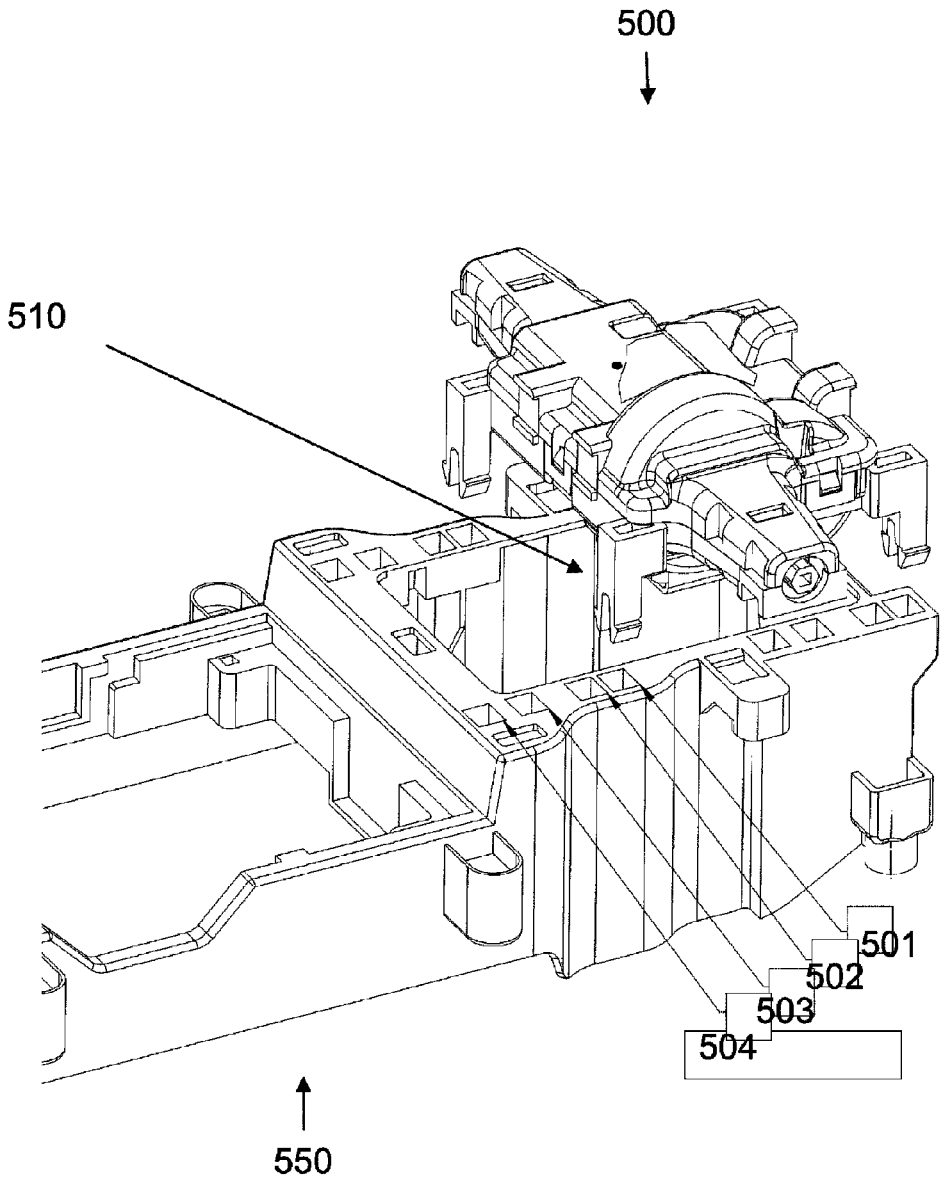
FIG. 5 illustrates a perspective view of an improved gear box and improved toy chassis.

FIG. 5 illustrates improved gear box 500 and improved chassis 550. In this example, improved gear box 500 includes four sets of clips 510, each set of clips 510 extending from the body of gear box 500. Improved chassis 550 includes four fitting positions, 501 through 504, each fitting position including four female interlocking portions that are arranged to correspond to the four sets of clips 510. It should be understood by those skilled in the art that four sets of clips and four fitting positions are merely illustrative, and that fewer or more sets could be employed. Clips 510 are male interlocking portions that can engage with the female interlocking portions on chassis 550. The four fitting positions 501 through 504 allow gear box 500 to be fitted onto chassis 550 in four different positions along a length of chassis 550. Assuming a fixed position for the front axle (not pictured in FIG. 5), the wheel distance, i.e. the longitudinal distance between the front wheel and the rear wheel, can be selected from among the four distances allowed by fitting positions 501 through 504. Fitting position 504 provides for the smallest wheel distance, while fitting position 501 provides for the largest wheel distance.

The four fitting positions 501 through 504 provide for adaptation to different wheelbases. Depending on the type of toy vehicle being assembled, which in turn has a bearing on the wheel distance, the clips 510 can be interlocked with the appropriate female interlocking portions. For example, a street version of a toy car might be selected with a different wheelbase than a racing version of a toy car. The multiple fitting positions illustrated in FIG. 5 allow for gear box 500 and chassis 550 to be used for a variety of types of toy vehicles with no additional modifications other than the selection of fitting positions to be used.

Figure 6:
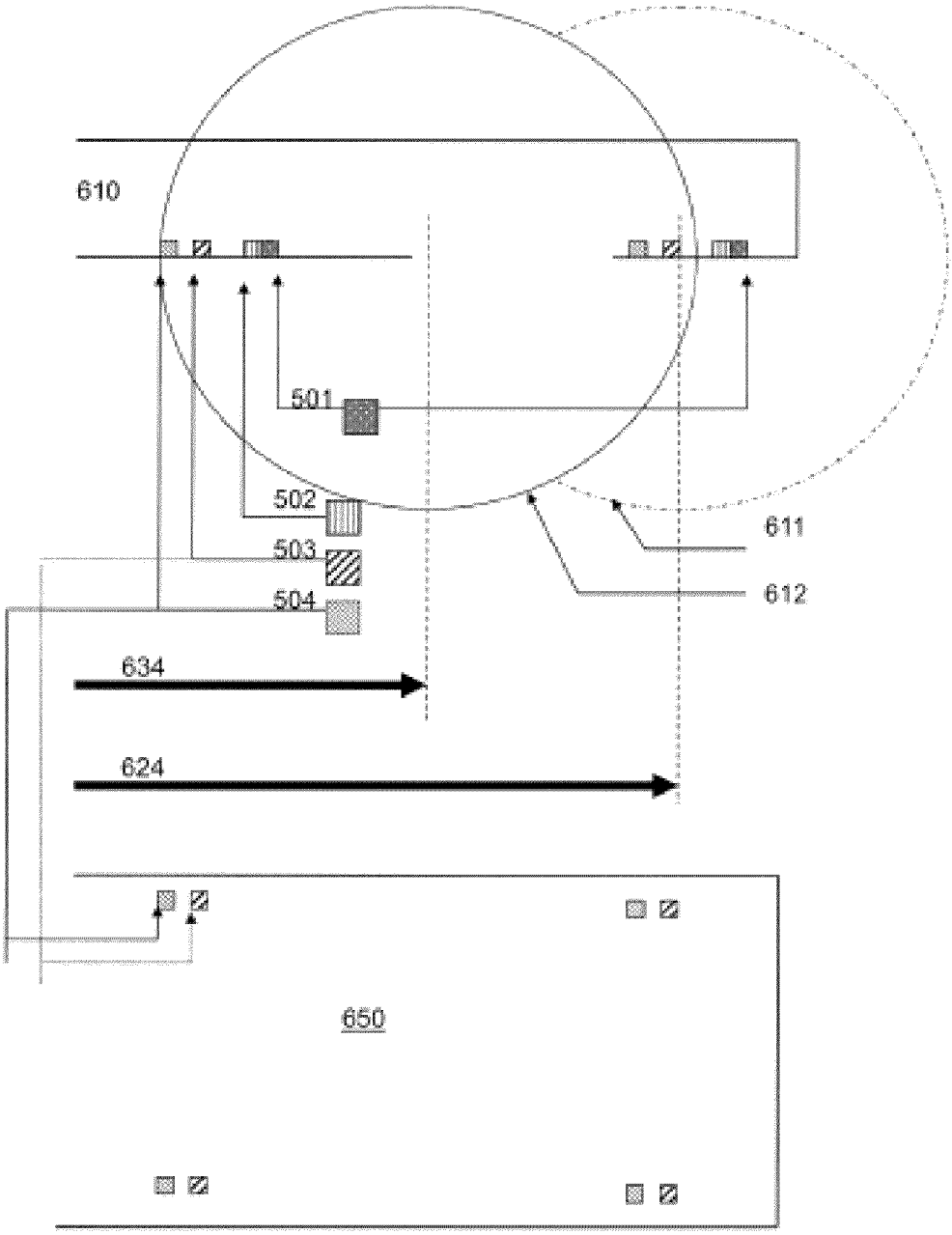
FIG. 6 illustrates the variation in longitudinal wheel distance with the improved gear box and improved chassis.

FIG. 6 illustrates the variation in longitudinal wheel distance with the improved gear box and improved chassis. A side view of chassis 610 is shown at the top of FIG. 6. Fitting positions 501 through 504 are also illustrated in FIG. 6. Dashed circle 611 illustrates the outer position of the rear wheel of the toy vehicle when fitting position 503 is used. Solid circle 612 illustrates the outer portion of the rear wheel of the toy vehicle when fitting position 504 is used. The arrow numbered 634 represents the wheel distance when the gear box is slotted into fitting position 504, while the arrow numbered 624 represents the wheel distance when the gear box is slotted into fitting position 503. The top view of the chassis 650 is represented at the bottom of FIG. 6.

The improved gear box described herein can be used in a wide range of toys that translate rotational movement and torque forces from a powered motor. For example and without limitation, the improved gear box can power a drive shaft that powers a toy car or truck, a propeller of a toy boat, plane or helicopter, the mechanical arm of a toy construction vehicle, and a broad range of light weight plastic and metal toys.

Although the invention has been described and illustrated in the foregoing illustrative embodiments, it is understood that the present disclosure has been made only by way of example, and that numerous changes in the details of implementation of the invention can be made without departing from the spirit and scope of the invention, which is limited only by the claims that follow. Features of the disclosed embodiments can be combined and rearranged in various ways within the scope and spirit of the invention.

The invention claimed is:

1. A gear box for use in a toy vehicle, the gear box comprising:

an upper cover having a grease groove and an integrated bush with a ridge; a motor engaged with the upper cover; a pinion gear engaged with the motor; a compound gear with integrated shaft engaged with the pinion gear; an output gear with an integrated shaft engaged with the compound gear, the integrated shaft of the output gear having a center portion with a substantially circular cross section and end portions with substantially hexagonal cross sections; and a lower cover engaged with the upper cover, wherein the integrated shaft of the output gear extends through the integrated bush of the upper cover, wherein the integrated shaft of the output gear contacts the integrated bush with a ridge in a grease groove, and where the grease groove is lubricated with grease to reduce the friction as the integrated shaft of the output gear rotates.

2. The gear box of claim 1, wherein the output gear is plastic, and wherein the output gear is molded with the integrated shaft as a composite piece of the same material.

3. The gear box of claim 2, wherein the lower cover further comprises plastic male locking portions;

wherein the upper cover further comprises plastic female locking portions; and wherein the lower cover is engaged with the upper cover via the male and female locking portions.

4. The gear box of claim 3, wherein the lower cover is engaged with the upper cover without the use of screws.

5. The gear box of claim 1, wherein the output gear with the integrated shaft has a shaft length, wherein the shaft length is between approximately three inches and eight inches.

6. The gear box of claim 5, wherein a length of the output gear integrated shaft is a function of the size of the gear box.

7. The gear box of claim 5, wherein the output gear with the integrated shaft has a shaft length of approximately four and one quarter inches.

8. The gear box of claim 1, wherein the grease is a silicone grease.

9. A toy vehicle comprising: a gear box for converting a higher speed motor to a lower speed and higher torque output, the gear box having an upper cover having a grease groove and an integrated bush with a ridge, a motor engaged with the upper cover, a pinion gear engaged with the motor, a compound gear with an integrated shaft engaged with the pinion gear, an output gear with an integrated shaft engaged with the compound gear, and at least one gear box connection element for connecting the gear box to a chassis, the integrated shaft of the output gear having a center portion with a substantially circular cross section and end portions with substantially hexagonal cross sections, and a lower cover engaged with the upper cover, wherein the integrated shaft of the output gear extends through the integrated bush of the upper cover; and a chassis having a plurality of chassis connection elements for connecting the chassis to the gear box, wherein the integrated shaft of the output gear contacts the integrated bush with a ridge in a grease groove, and where the grease groove is lubricated with grease to reduce the friction as the integrated shaft of the output gear rotates.

10. The toy vehicle of claim 9, wherein the output gear is plastic, and wherein the output gear is molded with the integrated shaft as a composite piece of the same material.

11. The toy vehicle of claim 10, wherein the lower cover further comprises plastic male locking portions;

wherein the upper cover further comprises plastic female locking portions; and wherein the lower cover is engaged with the upper cover via the male and female locking portions.

12. The toy vehicle of claim 11, wherein the lower cover is engaged with the upper cover without the use of screws.

13. The toy vehicle of claim 9, wherein the output gear with the integrated shaft has a shaft length, wherein the shaft length is between approximately three inches and eight inches.

14. The toy vehicle of claim 13, wherein a length of the output gear integrated shaft is a function of the size of the gear box.

15. The toy vehicle of claim 9, wherein the grease is a silicone grease.

16. The toy vehicle of claim 9, wherein the at least one gear box connection element comprises four male interlocking portions, and wherein the plurality of chassis connection elements comprises four female interlocking portions.

17. The toy vehicle of claim 16, wherein the chassis has four sets of the plurality of connection elements.

* * * * *